US008079753B2

(12) United States Patent
Sebree

(10) Patent No.: US 8,079,753 B2
(45) Date of Patent: Dec. 20, 2011

(54) AGITATOR TOOL FOR PROGRESSIVE CAVITY PUMP

(75) Inventor: John Sebree, Lloydminster (CA)

(73) Assignee: 1350363 Alberta Ltd., Lloydminster, Alberta (CA)

( * ) Notice: Subject to any disclaimer, the term of this patent is extended or adjusted under 35 U.S.C. 154(b) by 658 days.

(21) Appl. No.: 12/272,971

(22) Filed: Nov. 18, 2008

(65) Prior Publication Data

US 2010/0124146 A1 May 20, 2010

(51) Int. Cl.
*B01F 7/16* (2006.01)

(52) U.S. Cl. ..... 366/308; 366/343; 366/241; 366/279

(58) Field of Classification Search ..... 366/241, 366/279, 308, 343
See application file for complete search history.

(56) References Cited

U.S. PATENT DOCUMENTS

| | | | | |
|---|---|---|---|---|
| 202,570 | A | 4/1878 | Minniss et al. | |
| 1,734,120 | A * | 11/1929 | Farrington | 366/308 |
| 2,229,541 | A | 5/1939 | Zublin | |
| 5,015,162 | A | 5/1991 | Heppner | |
| 5,197,803 | A * | 3/1993 | Wall et al. | 366/309 |
| 5,209,293 | A | 5/1993 | McNaughton et al. | |
| 5,447,200 | A | 9/1995 | Dedora et al. | |
| 5,525,146 | A | 6/1996 | Straub | |
| 6,305,837 | B1 * | 10/2001 | Clavel et al. | 366/308 |
| 6,523,612 | B2 | 2/2003 | Reynolds | |
| 6,705,402 | B2 | 3/2004 | Proctor | |
| 7,343,967 | B1 | 3/2008 | Floyd | |
| 2004/0223404 | A1 * | 11/2004 | Hughes | 366/191 |
| 2006/0048934 | A1 | 3/2006 | Charabin | |
| 2008/0093083 | A1 | 4/2008 | Johnson | |
| 2010/0014379 | A1 * | 1/2010 | Wright et al. | 366/308 |

FOREIGN PATENT DOCUMENTS

| | | |
|---|---|---|
| CA | 555399 | 4/1958 |
| CA | 720716 | 11/1965 |
| CA | 1192127 | 8/1985 |
| CA | 2029082 | 5/1991 |
| CA | 2110300 | 12/1992 |
| CA | 2232044 | 9/1998 |
| CA | 2306259 | 10/2001 |
| CA | 2388191 | 11/2003 |
| CA | 2433627 | 12/2004 |
| CA | 2506443 | 11/2006 |
| CA | 2516341 | 1/2007 |

* cited by examiner

*Primary Examiner* — Maria Veronica Ewald
*Assistant Examiner* — Robert J Grun
(74) *Attorney, Agent, or Firm* — Bennett Jones LLP.

(57) ABSTRACT

The invention relates to an agitator tool for use with a progressive cavity pump for agitating a slurry of sand, heavy oil or water. The agitator tool has an elongate body having a lower end, an upper end, and a plurality of longitudinal grooves spaced between the lower and upper ends and radially about the body. The upper end is configured for coupling to a pump rotating element. Agitation members are pivotally mounted within the longitudinal grooves so as to be movable from an actuation position wherein the agitation members project outwardly from the body during rotation to agitate the slurry, to resting positions wherein the agitation members are folded within the grooves during installation or removal of the tool.

12 Claims, 7 Drawing Sheets

AGITATOR TOOL FOR PROGRESSIVE CAVITY PUMP

FIELD OF THE INVENTION

This invention relates to an agitator tool for a progressive cavity pump.

BACKGROUND OF THE INVENTION

Progressive cavity pumps have been used for decades to pump medium to high viscosity fluids commonly filled with solid particulate material (for example, sand, glass beads, glass balloons and metallic or organic fillers, i.e., quartz, aluminum oxide, and titanium oxide) from an oil well to the surface through a production tubing string. A typical progressive cavity pump system includes a surface drive and a downhole progressive cavity pump with a single helical-shaped rotor which turns eccentrically inside a double helical elastomer-lined stator. The stator is attached to the bottom of a production tubing string and, in most cases, the rotor is attached to a rod string suspended and rotated by the surface drive. The shapes of the rotor and stator form a series of sealed cavities within the stator. As the rotor is turned, the cavities progress to move fluid from the intake to the discharge end of the pump, thereby producing a pulsationless positive displacement flow. The elastomer surface of the stator is intended to help the pump handle abrasive and viscous fluids. However, when a progressive cavity pump is situated in a heavy oil well, it is common for solid particulate material carried by heavy oil to plug up the pump, preventing further production from the well. Flushing of the pump is then required, which consumes time and delays production. Solid particulate material may also contribute to the wear-and short operating life-of parts, for example, the stator.

Therefore, there is a need in the art for an apparatus which mitigates these limitations.

SUMMARY OF THE INVENTION

The present invention relates to an agitator tool for use in a progressive cavity pump.

In one aspect, the invention provides a tool for use with a progressive cavity pump for agitating a slurry of sand, heavy oil or water comprising:

(a) an elongate body having a lower end, an upper end, and defining a plurality of longitudinal grooves spaced between the lower and upper ends and radially about the body;

(b) the upper end configured for coupling to a pump rotating element;

(c) a plurality of agitation members pivotally mounted within the longitudinal grooves so as to be foldable from an actuation position wherein the agitation members project outwardly from the body, to resting positions wherein the agitation members are folded within the grooves during installation and removal of the tool; and (d) biasing means for biasing the agitation members towards the actuation position.

In one embodiment, the biasing means comprises springs through which cap screws extend to pivotally mount the agitation members within the longitudinal grooves.

In one embodiment, the cap screws are countersunk and threaded through aligned bores defined in opposing side walls of the longitudinal grooves.

In one embodiment, the springs are helical torsion springs, each having attachment means at its ends to secure the spring within the longitudinal groove at one end and to attach the spring to the agitation member at the other end.

In one embodiment, the agitation members are positioned in sets of pairs along the length and radially about the body.

In one embodiment, the agitation members are formed in the shape of a rectangle having a notch-like recess for receiving and accommodating the spring.

In one embodiment, the upper end is externally threaded for connection with an internally threaded coupling at the bottom end of a rotating element.

In one embodiment, a horizontal, annular shoulder is formed by the body at a junction of the upper end and the body.

In one embodiment, the lower end has a flat, horizontal surface.

In one embodiment, the lower end may be tapered, pointed, conical, or beveled.

In one embodiment, the longitudinal grooves span a portion or substantially the entire length of the body between its ends.

In one embodiment, the longitudinal grooves are spaced intermittently and in alignment along the length of the body with a clearance between each groove.

Additional aspects and advantages of the present invention will be apparent in view of the description, which follows. It should be understood, however, that the detailed description and the specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention will now be described by way of an exemplary embodiment with reference to the accompanying simplified, diagrammatic, not-to-scale drawings. In the drawings.

DETAILED DESCRIPTION OF PREFERRED EMBODIMENTS

When describing the present invention, all terms not defined herein have their common art-recognized meanings.

To the extent that the following description is of a specific embodiment or a particular use of the invention, it is intended to be illustrative only, and not limiting of the claimed invention. The following description is intended to cover all alternatives, modifications and equivalents that are included in the spirit and scope of the invention, as defined in the appended claims.

Figure 1:
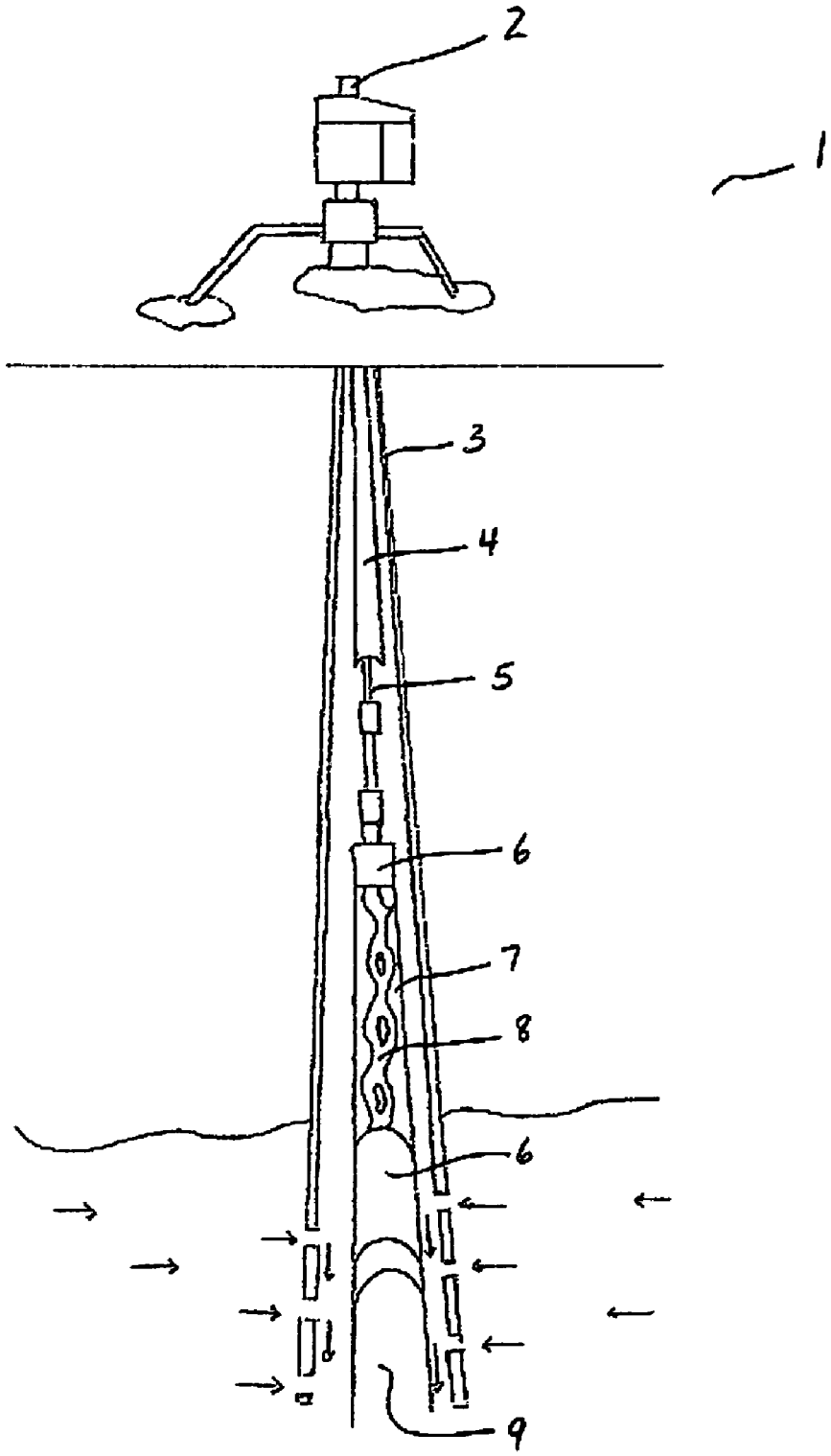
FIG. 1 (PRIOR ART)
FIG. 1 is a diagrammatic representation of a side sectional view of a conventional, prior art progressive cavity pump system.

The present invention provides an agitator tool for use in a progressive cavity pump. A conventional prior art progressive cavity pump (1) for a production well is shown in FIG. 1 (Weatherford, Tex., U.S.A.). The components include, sequentially from the top to bottom, a vertical electric wellhead drive (2), casing (3), production tubing (4), sucker rod (5), tubing collars (6), stator (7), rotor (8) and tag bar sub (9). The agitator tool of the present invention connects to the bottom end of a standard rotor, and agitates solid particulate material (for example, sand) and oil into a slurry which can easily be pumped. Agitation or mixing of the solid particulate material and oil prevents such materials from clumping and blocking the inflow to the progressive cavity pump, and helps with gas breakout by agitating the gas pockets mixed with the solid particulate material and oil. The tool is suitable for handling any type of fluid and abrasive compound or sand mixture, or simply fluid and gas.

Figure 2:
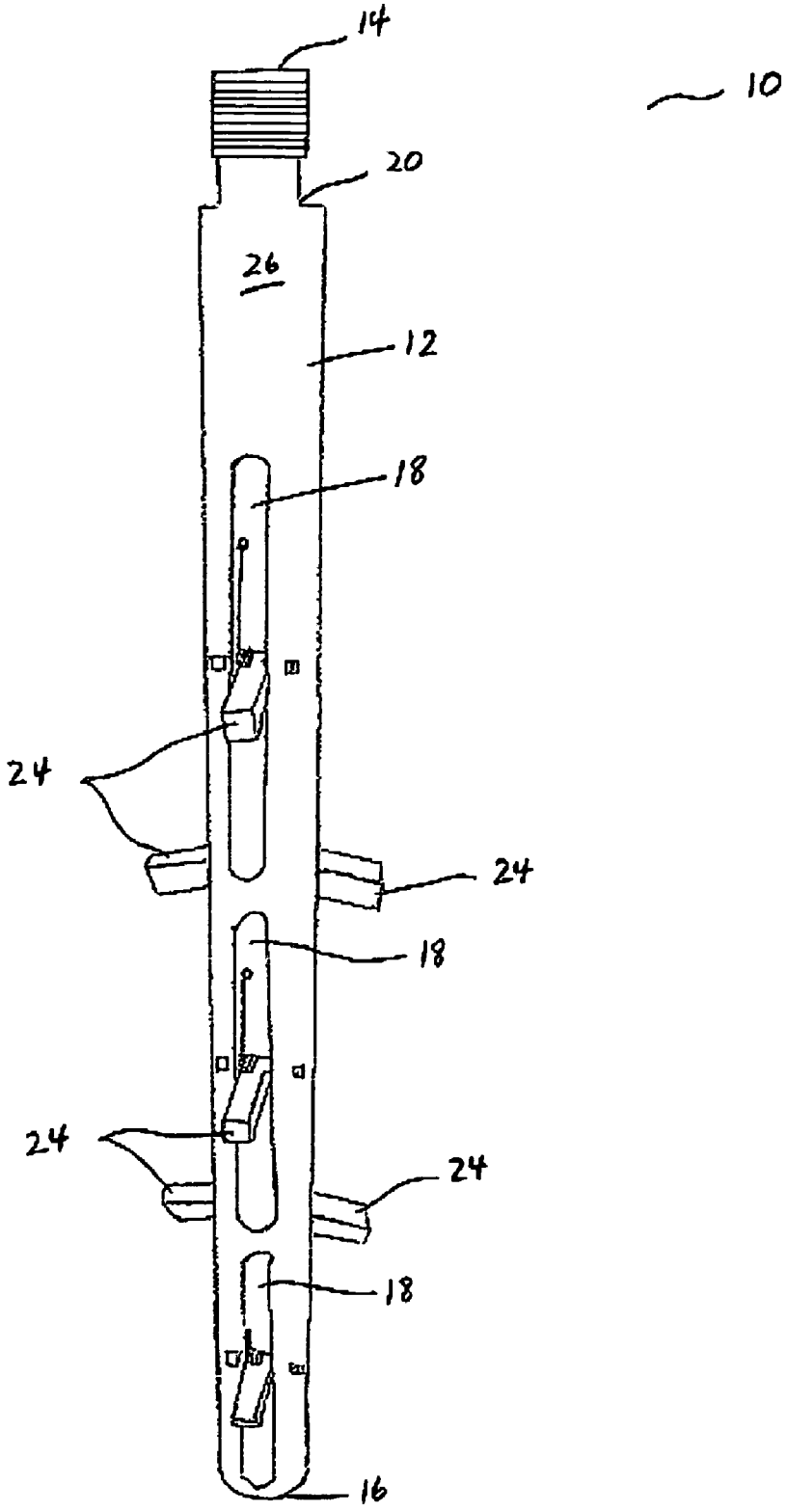
FIG. 2 is a diagrammatic representation of a side view of a tool of the present invention.

The tool (10) is generally shown in FIG. 2 to include an elongate body (12) having an upper end (14), a lower end (16), and defining a plurality of longitudinal grooves (18) spaced between the upper and lower ends (14, 16) and radially about the body (12).

The dimensions of the tool (10) are not essential to the invention and are dictated by the size of the pump (1) and the production tubing (4). Typically, the body (12) of the tool (10) may be in the range of 1 to 5 feet in length in a longitudinal direction of the production tubing string and have a diameter in the range of 2" to 6". The body (12) of the tool (10) may have a diameter which is the same or smaller than the diameter of the stator (7).

Figure 3:
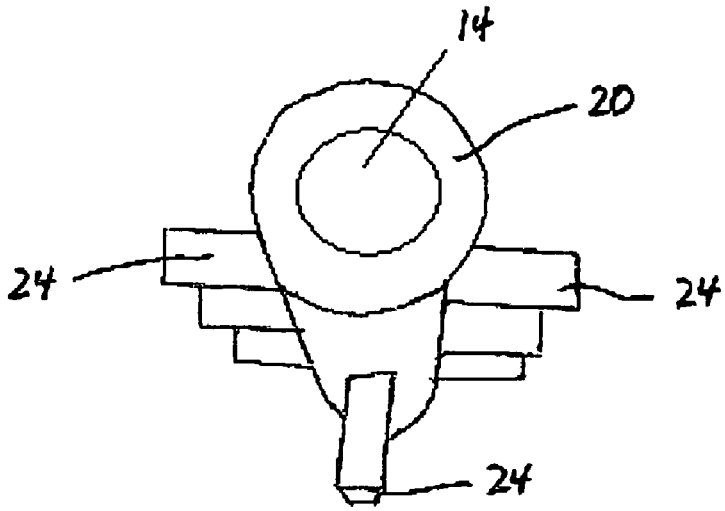
FIG. 3 is a diagrammatic representation of a top view of a tool of the present invention.

The upper end (14) is configured for coupling to a pump rotating element (not shown) to provide for rotation of the rotating element (not shown) and the body (12) of the tool (10) about a common axis. In one embodiment, the upper end (14) is externally threaded for connection with an internally threaded coupling at the bottom end of the rotating element, as shown in FIGS. 2 and 3. A horizontal, annular shoulder (20) is formed by the body (12) at the junction of the upper end (14) and body (12) portions. Other suitable connection means to allow the tool (10) to be installed or released from the rotating element are well known to those skilled in the art such as, for example, screw-on couplings and shear pins.

It will be understood by those skilled in the art that if desired, the tool (10) can be permanently attached to the rotating element by welding or other known techniques if the tool (10) is to be used regularly or solely in a particular well.

Figure 4:
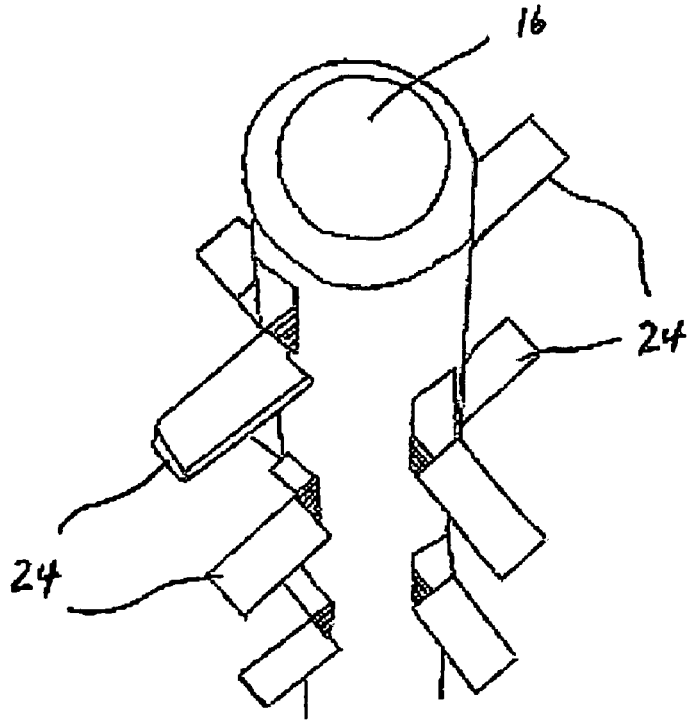
FIG. 4 is a diagrammatic representation of a bottom view of a tool of the present invention.

The lower end (16) is configured to be suspended above the bottom of the well. In one embodiment, the lower end (16) has a flat, horizontal surface, as shown in FIG. 4. In other embodiments, the lower end (16) may be, for example, tapered, pointed, conical, or beveled.

Figure 5:
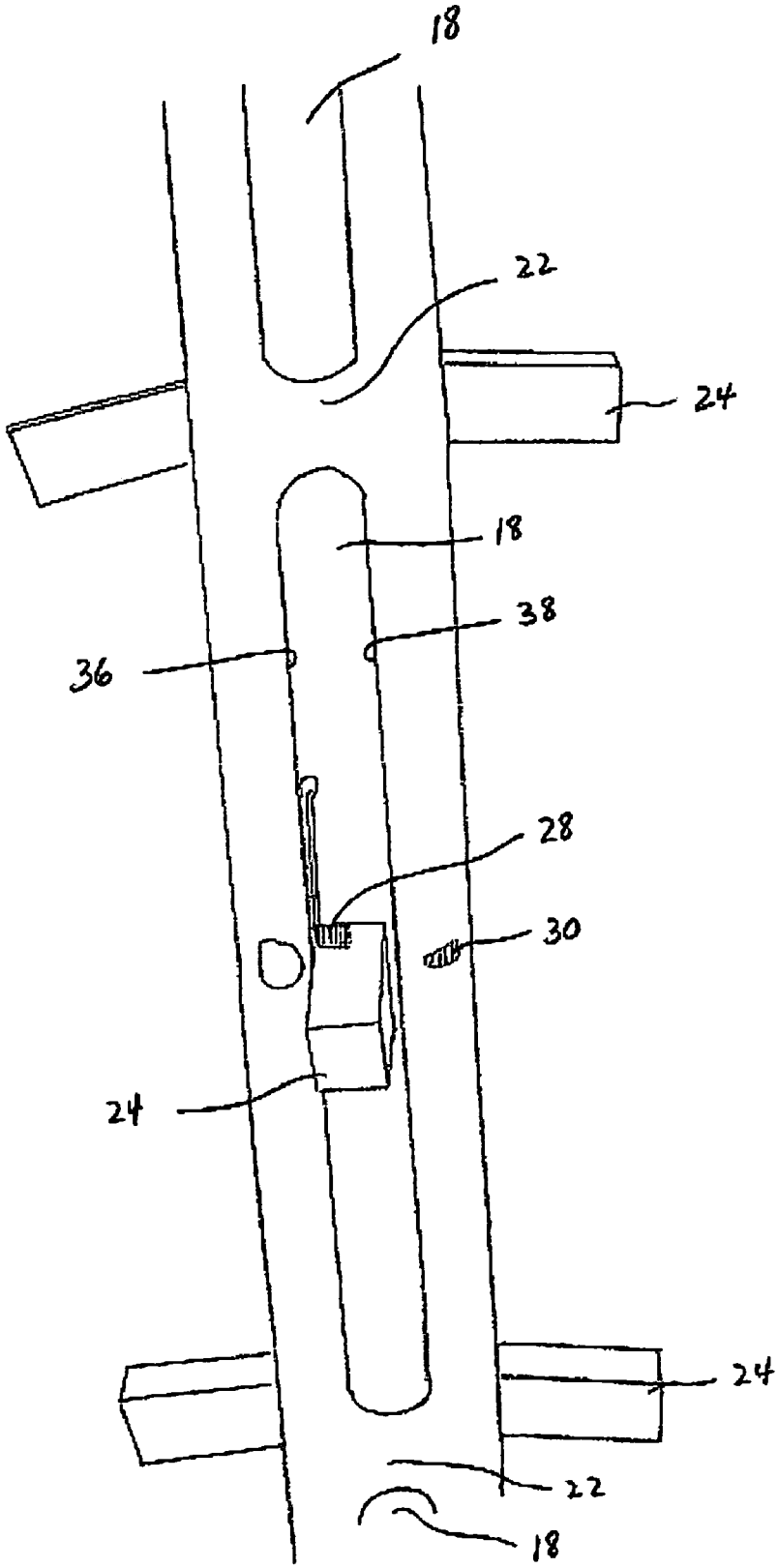
FIG. 5 is a diagrammatic representation showing a side view of an agitation member mounted within a groove of the tool of FIG. 1.

The longitudinal grooves. (18) are spaced between the upper and lower ends (14, 16) and radially about the body (12). The grooves (18) may span a portion or substantially the entire length of the body (12) between its ends (14, 16). In one embodiment, the grooves (18) are spaced intermittently and in alignment along the length of the body (12), with a clearance (22) between each groove (18), as shown in FIG. 5. The grooves (18) are of sufficient lengths to accommodate agitation members (24) in both the upward and downward resting positions. In one embodiment, the grooves (18) are at least twice the length of an agitation member (24). The grooves (18) are formed within the surface (26) of the body (12) by machining or other known techniques.

The agitation members (24) are pivotally mounted within the grooves (18) to enable three positions of movement, namely an actuation position, an upward resting position, and a downward resting position. The agitation members (24) are movable from the actuation position wherein the agitation members project outwardly from the body (12) during rotation to agitate the slurry, to the resting positions wherein the agitation members (24) are folded within the grooves (18) during installation or removal of the tool (10).

The agitation members (24) are normally biased by biasing means towards an actuation position (FIGS. 2-6 and 8). As used herein and in the claims, the term "actuation position" refers to the agitation members (24) projecting outwardly from the body (12) at an angle sufficient to enable agitation of solid particulate material when the body is rotated. The angle may range from approximately 20° to 90°. In one embodiment, the agitation members (24) may project outwardly from the body (12) at an initial angle ranging from approximately 20° to 45°, with the angle gradually reaching approximately 90° (i.e., the agitation members positioned in a substantially horizontal orientation) as the speed of rotation increases during operation. In one embodiment, the agitation members (24) are positioned in sets of pairs along the length and radially about the body (12), as shown in FIG. 4.

Figure 6:
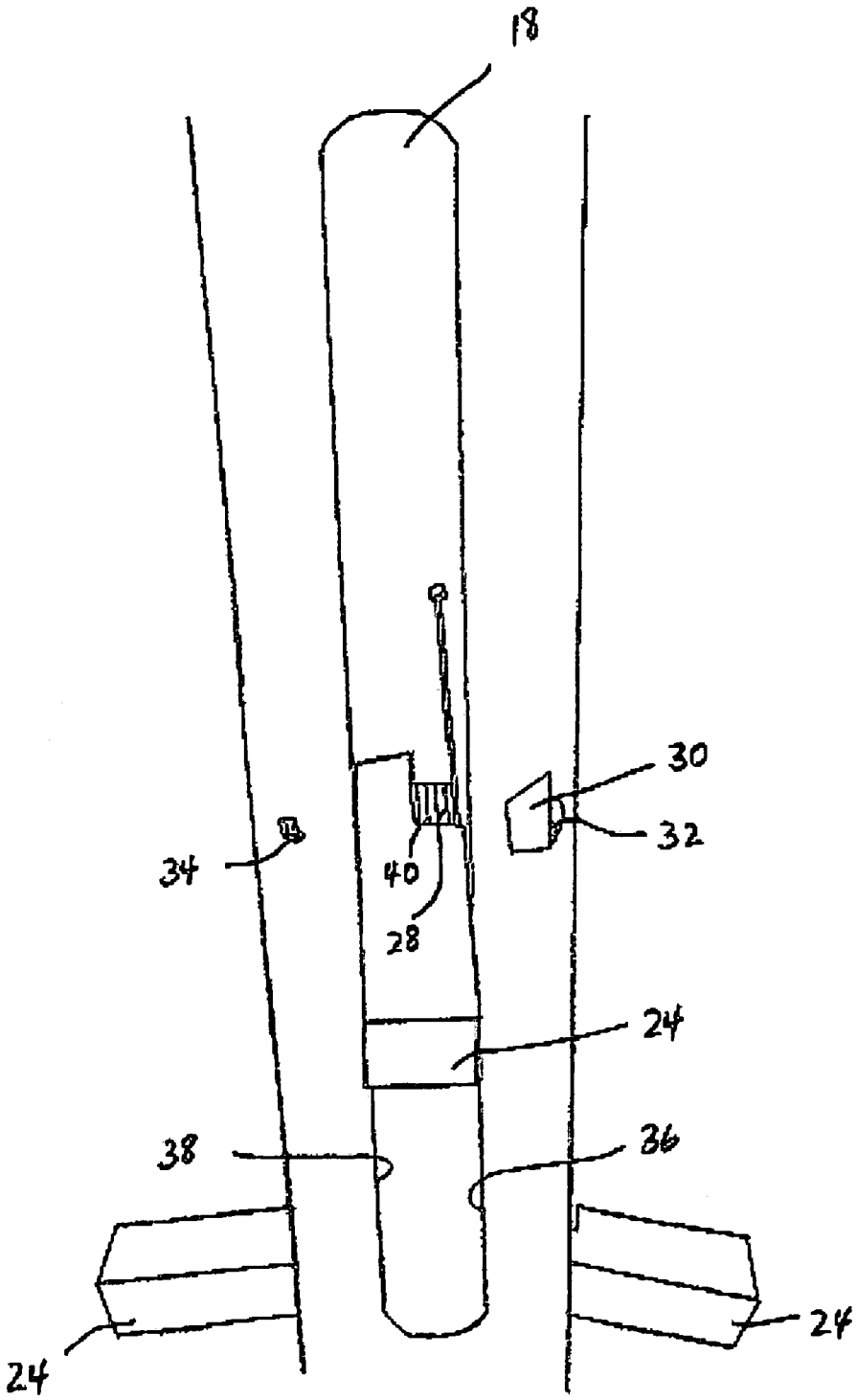
FIG. 6 is a diagrammatic representation showing a side view of an agitation member mounted within a groove of the tool of FIG. 1.

FIGS. 5 and 6 illustrate the biasing means as comprising a spring (28) through which a cap screw (30) extends to pivotally mount the agitation member (24) within the groove (18). The cap screw (30) is countersunk and threaded through aligned bores (32, 34) defined in the opposing side walls (36, 38) of the groove (18). In one embodiment, the spring (28) is a helical torsion spring having a hook, eye or other suitable attachment means at its ends to secure the spring (28) within the groove (18) at one end, and to attach the spring (28) to the agitation member (24) at the other end.

Figure 7A:
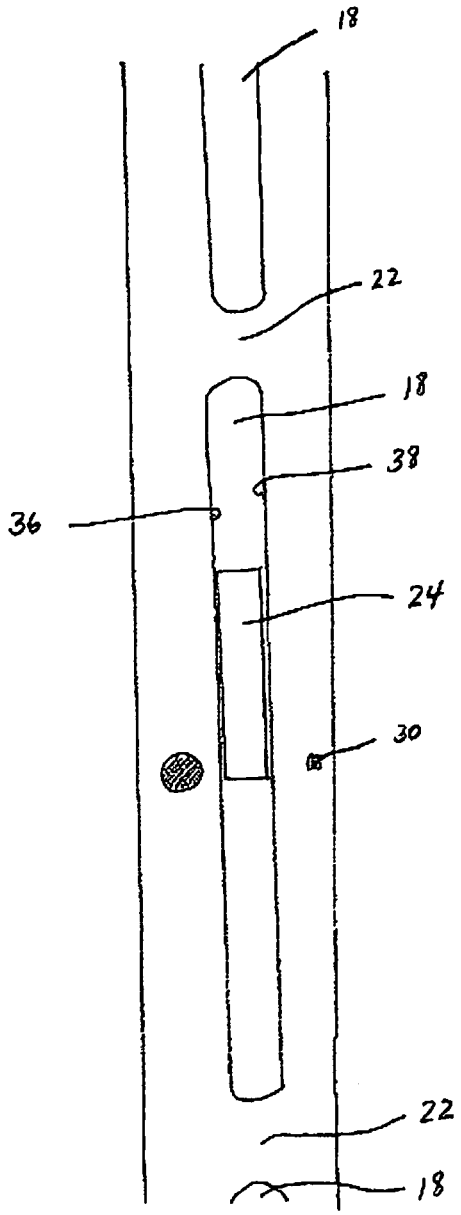
FIG. 7*a* is a diagrammatic representation showing a side view of an agitation member in the upward resting position within a groove of the tool of FIG. 6.
Figure 7B:
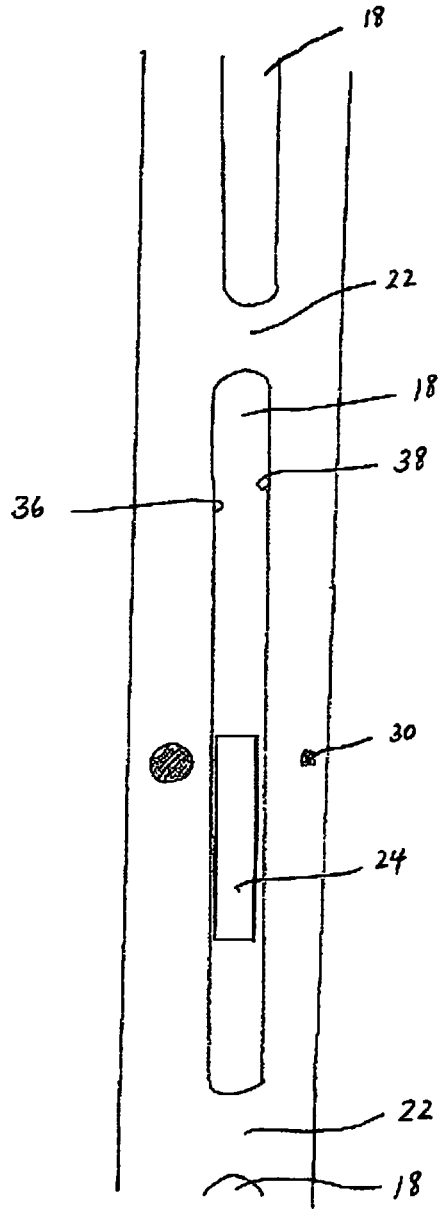
FIG. 7*b* is a diagrammatic representation showing a side view of an agitation member in the downward resting position within a groove of the tool of FIG. 6.

The biasing means permits the agitation members (24) to fold into the grooves (18) either upwardly for installation into the well or downwardly for removal from the well in a controlled manner. As the tool (10) is being installed into the well, the agitation members (24) are folded into the grooves (18) upwardly for installation into the well (i.e., the upward resting position as shown in FIG. 7*a*). As the tool (10) is retrieved from the well, the agitation members (24) are folded into the grooves (18) downwardly for removal from the well (i.e., the downward resting position as shown in FIG. 7*b*).

The agitation members (24) may comprise various shaped projections such as bars, blades, fins, beveled paddles, or the like. Other shapes such as, for example, round, flat, octagonal, or triangular, may be appropriate. In one embodiment, the agitation member (24) is formed in the shape of a rectangle having at one end, a notch-like recess (40) which receives and accommodates the spring (28) when the agitation member (24) is mounted within the groove (18), as shown in FIG. 6. The agitation members (24) are sized to fit within the grooves (18). The dimensions of the agitation members (24) are thus dictated by the size of the grooves (18).

The tool (1) can be constructed from any material or combination of materials having suitable properties such as, for example, mechanical strength, ability to withstand cold and adverse field conditions, corrosion resistance, and ease of machining. In one embodiment, the body (12) and agitation members (24) are formed of steel, for example, stainless steel and 4140 alloy steel. In one embodiment, the body (12) and agitation members (24) are formed of aluminum or other appropriate materials known to those skilled in the art. The springs (28) may be formed of wire, rubber or metal. The cap screws (30) may be formed of steel, for example, stainless steel, and strength-bearing materials.

Figure 8:
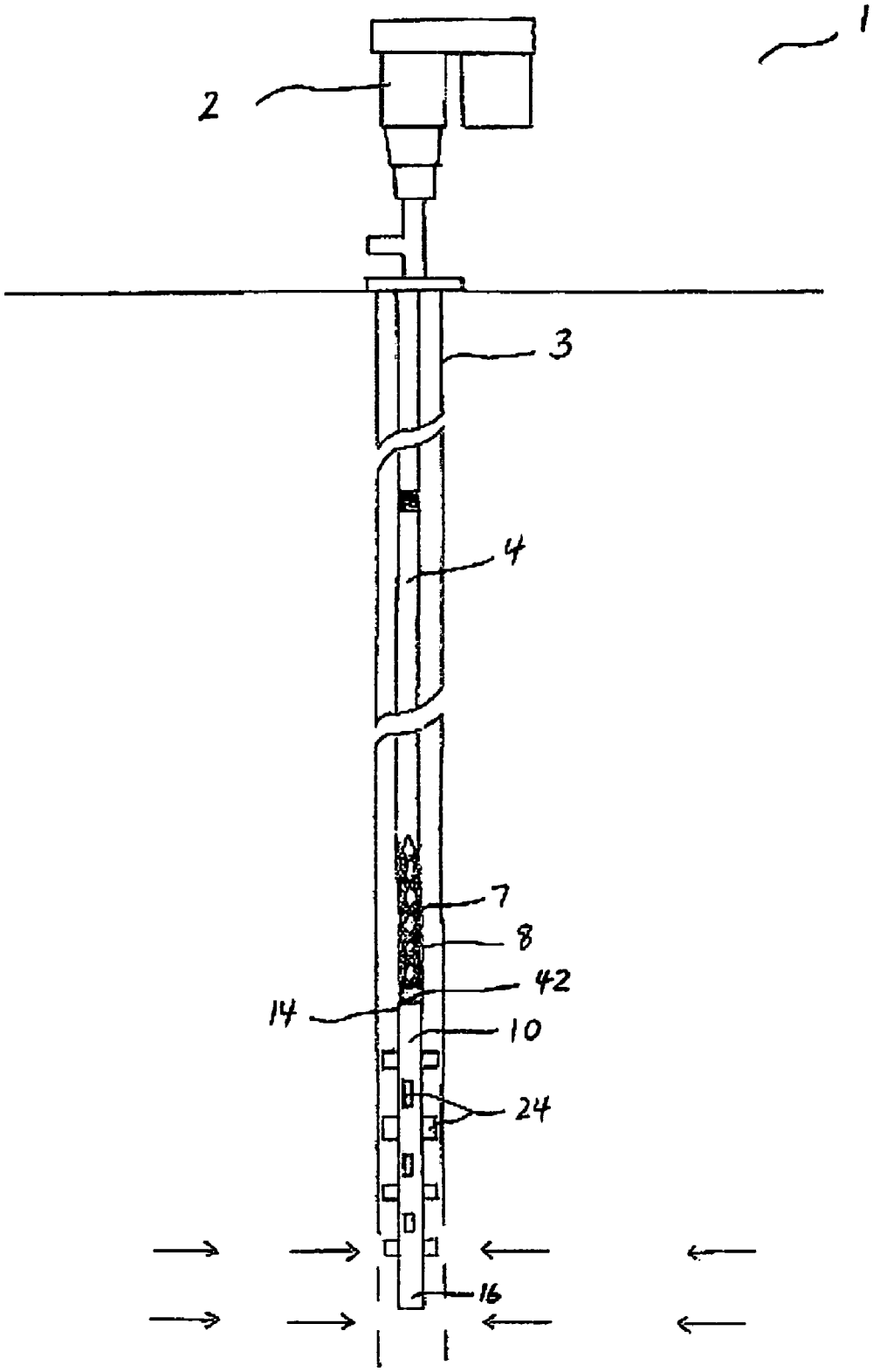
FIG. 8 is a diagrammatic representation of a tool of the present invention in an actuation position within a progressive cavity pump.

The operation of progressive cavity pumps is commonly known to those skilled in the art and will not be discussed in detail. A typical progressive cavity pump (1) is mounted within the well tubulars, for example, the production casing (3) of a conventional well. As shown in FIG. 8, the components include, sequentially from the top to bottom, a vertical electric wellhead drive (2), casing (3), production tubing (4), stator (7) and rotor (8). During installation of the tool (10), the tag bar sub (9, see FIG. 1) is removed. An oversized coupling (42) is welded to allow tag or contact on the rotating element (i.e., the rotor (8)). The upper end (14) of the tool (10) is connected to the bottom end of the rotating element (8). The rotating element (8) and connected tool (10) are then fed through the stator (7) to a depth at which the lower end (16) of the tool (10) is placed within the formation. As the tool (10) is being fed downwardly into the well, the agitation members (24) fold upwardly into the grooves (18) in the resting position, thereby facilitating installation. Once the tool (10) has reached its operating position, below the stator (7), the agitation members are urged outward to their actuation position due to the operation of the springs (28).

In operation, the tool (10) is rotated with the rotating element (8) of the pump. As the rotating element reaches 100 to 300 rpm, the springs (28) hold the agitation members (24) in the actuation position to agitate solid particulate material and production fluid (i.e., oil) into a slurry which can be easily drawn from the well to the surface. Centrifugal force may also contribute to the agitation members being drawn into their actuation position. The agitation members (24) also facilitate gas breakout by agitating the gas pockets mixed with the solid particulate material and oil. As the rotating element (8) and tool (10) are lifted upwardly from the well following production, the agitation members (24) fold downwardly into the grooves (18) in the resting position, thereby facilitating removal from the well.

Importantly, installation or removal of the tool (10) (together with the rotating element attached to the upper end (14) of the tool (10)) is enabled by the spring-loading of the agitation members (24). The tool (10) can be readily connected or detached from a rotating element for inspection, reinsertion or replacement if necessary.

As will be apparent to those skilled in the art, various modifications, adaptations and variations of the foregoing specific disclosure can be made without departing from the scope of the invention claimed herein.

What is claimed is:

1. A tool for use with a progressive cavity pump for agitating a slurry of sand, heavy oil or water comprising:

(a) an elongate body having a lower end, an upper end, and defining a plurality of longitudinal grooves spaced between the lower and upper ends and radially about the body;

(b) the upper end configured for coupling to a pump rotating element;

(c) a plurality of agitation members pivotally mounted within the longitudinal grooves so as to be foldable from an actuation position wherein the agitation members project outwardly from the body, to resting positions wherein the agitation members are folded within the grooves during installation and removal of the tool; and (d) biasing means for biasing the agitation members towards the actuation position.

2. The tool of claim 1, wherein the biasing means comprises springs through which cap screws extend to pivotally mount the agitation members within the longitudinal grooves.

3. The tool of claim 2, wherein the cap screws are countersunk and threaded through aligned bores defined in opposing side walls of the longitudinal grooves.

4. The tool of claim 2, wherein the springs are helical torsion springs, each having attachment means at its ends to secure the spring within the longitudinal groove at one end and to attach the spring to the agitation member at the other end.

5. The tool of claim 1, wherein the agitation members are positioned in sets of pairs along the length and radially about the body.

6. The tool of claim 1, wherein the agitation members are formed in the shape of a rectangle having a notch-like recess for receiving and accommodating the spring.

7. The tool of claim 1, wherein the upper end is externally threaded for connection with an internally threaded coupling at the bottom end of a rotating element.

8. The tool of claim 7, wherein a horizontal, annular shoulder is formed by the body at a junction of the upper end and the body.

9. The tool of claim 1, wherein the lower end has a flat, horizontal surface.

10. The tool of claim 1, wherein the lower end may be tapered, pointed, conical, or beveled.

11. The tool of claim 1, wherein the longitudinal grooves span a portion or substantially the entire length of the body between its ends.

12. The tool of claim 11, wherein the longitudinal grooves are spaced intermittently and in alignment along the length of the body with a clearance between each groove.

* * * * *